US006312189B1

(12) United States Patent
Marphetia

(10) Patent No.: US 6,312,189 B1
(45) Date of Patent: Nov. 6, 2001

(54) VEHICLE TIRE PUNCTURING AND DEFLATING SPIKE AND ASSEMBLY THEREFOR

(76) Inventor: Toranj Marphetia, 20860 Heathview Dr., Brookfield, WI (US) 53045

( * ) Notice: Subject to any disclaimer, the term of this patent is extended or adjusted under 35 U.S.C. 154(b) by 0 days.

(21) Appl. No.: 09/548,333

(22) Filed: Apr. 12, 2000

Related U.S. Application Data

(60) Provisional application No. 60/134,630, filed on May 18, 1999.

(51) Int. Cl.[7] ..... G01F 13/12
(52) U.S. Cl. ..... 404/6
(58) Field of Search ..... 404/6; 256/1; E01F 13/12

(56) References Cited

U.S. PATENT DOCUMENTS

| | | | | |
|---|---|---|---|---|
| 2,912,229 | * | 11/1959 | Persgard | 404/6 |
| 3,652,059 | * | 3/1972 | Groblebe | 256/1 |
| 4,382,714 | * | 5/1983 | Hutchison | 404/6 |
| 4,995,756 | | 2/1991 | Kilgrow et al. . | |
| 5,099,579 | * | 3/1992 | Chadwick | 30/366 |
| 5,123,774 | * | 6/1992 | Dubiel | 404/6 |
| 5,253,950 | * | 10/1993 | Kilgrow et al. | 404/6 |
| 5,482,397 | | 1/1996 | Soleau . | |
| 5,536,109 | | 7/1996 | Lowndes . | |
| 5,588,774 | | 12/1996 | Behan . | |
| 6,048,128 | * | 4/2000 | Jones, III et al. | 404/6 |

FOREIGN PATENT DOCUMENTS

| | | | | |
|---|---|---|---|---|
| 2 187 491 | * | 9/1987 | (GB) | 404/6 |

OTHER PUBLICATIONS

"SafeStop Magnum Spike System," Phoenix International Ltd. V.*

* cited by examiner

*Primary Examiner*—Thomas B. Will
*Assistant Examiner*—Gary S. Hartmann
(74) *Attorney, Agent, or Firm*—Joseph S. Heino

(57) ABSTRACT

A metal spike has a plurality of sharp blades which are functionally adapted for puncturing a rubber tire as the tire passes over the spike. As the rubber tire moves away from the spike assembly or array, the spike is withdrawn from the holder and remains embedded in the tread of the tire. The spike includes a plurality of grooves which extend along the body of the spike and between adjacent blades to allow pressurized air escaping from the tire to run along the spike grooves and to a central internal airflow vent until the tire is partially or completely deflated.

14 Claims, 2 Drawing Sheets

VEHICLE TIRE PUNCTURING AND DEFLATING SPIKE AND ASSEMBLY THEREFOR

This Application claims the benefit of U.S. Provisional Application No. 60/134,630, filed May 18, 1999.

FIELD OF THE INVENTION

This invention relates generally to devices used by law enforcement agencies and the like for puncturing the rubber tires of a motor vehicle, thereby slowing down and eventually stopping such motor vehicle. More particularly, this invention relates to an improved tire puncturing device which utilizes a tire deflating spike which is constructed and configured so as to facilitate the flow of air out of a rubber vehicle tire once the rubber tire is punctured by the deflating spike. It also relates to an array or an assembly having a plurality of such deflating spikes for use with the device.

BACKGROUND OF THE INVENTION

It has long been recognized that it is occasionally necessary for law enforcement agencies to impede and altogether stop the movement of a run-away motor vehicle. Direct pursuit of such vehicles is often necessary, but brings with it concerns for public safety when such pursuits lead through city streets and other populated areas. Because such pursuits can also result in high speed chases, the safety of the pursuers is also a concern.

As a safer alternative to the direct pursuit of such vehicles, it has been recognized that strategic placement of tire deflating mechanisms in the path, or the anticipated path, of such run-away motor vehicles can effectively impede and stop the movement of them. Such portable tire deflating mechanisms can be deployed with relative ease and have taken several forms in recent years. One such mechanism is a multiple blade system whereby a plurality of blades, which blades are biased in the direction of the oncoming motor vehicle, are deployed. See, for example, U.S. Pat. No. 5,588,774 issued to Behan. Other systems have been used which utilize what amount to large hollow needles or syringes. See, for example, U.S. Pat. No. Re. 35,373 issued to Kilgrow et al. Still other systems utilize pyramidal spikes. See, for example, U.S. Pat. No. 5,536,109 issued to Lowndes. While each of these systems is, in the experience of this inventor, useful in its own right, each such array has functional limitations when the deflating mechanisms are confronted with the prospect of stopping a motor vehicle fitted with modem tires of the multiple layered, steel belted, self-sealing type. Such tires are specifically designed and configured to resist and possibly completely neutralize tire puncturing obstacles, including those intended as well as unintended. In the experience of this inventor, blade arrays have the drawback that, while they may cut through the rubber tread, a sharp blade will not be able to cut through several mesh steel wire belts thereby completely frustrating the tire deflating intention of the blade array device. Similarly, a needle-like or syringe-like puncturing device may even remain within the tire, but to no adverse result if a plug of rubber tire material becomes lodged within the inner void of the puncturing device, much the same as a cookie cutter can and does. Finally, other deflating device structures may remain in the tire, but to no avail and with no way to remove air from the tire until the deflating device becomes dislodged from the tire. Another safety concern arises with the use of such devices. And that is that such devices may eventually be dislodged and thrown from the motor vehicle tires they have impaled, thereby causing a safety concern for those in pursuit of such vehicles.

SUMMARY OF THE INVENTION

It is, therefore, a principal object of this invention to provide a new, useful and uncomplicated device for quickly and efficiently puncturing and deflating the rubber tires of a motor vehicle. It is a further object of this invention to provide such a tire deflating device which requires only a minimal number of elements and which effectively enhances air flow from the tire along the outside of the device and then transfers the air flow to the interior of the device. It is yet another object of this invention to provide such a device which can be readily used in a variety of tire deflating arrays and which effectively punctures most, if not all, modem inflatable rubber tire constructions. It is still another object of this invention to provide such a device which remains imbedded in the rubber tire until removal is desired or required. It is still another object of this invention to provide such a device which minimizes the fracturing of puncturing device tips and which avoids any rubber tire material plug from being created in the tire puncturing process.

The present invention has obtained these objects. It provides for a rubber tire puncturing and deflating device which is insertable within and removable from a holder of an array of such devices. The tire puncturing and deflating device of the present invention comprises a metal spike having a plurality of sharp, fluted edges which are functionally adapted for puncturing a rubber tire as the tire passes over the spike. As the rubber tire moves away from the spike assembly or array, the fluted spike is withdrawn from the holder and remains imbedded in the tread of the tire. The spike of the present invention includes a plurality of grooves which extend along the body of the spike to allow pressurized air escaping from the tire to run along the spike grooves and to a plurality of air flow vents. Each air flow vent is an access opening to the interior of the spike which allows the pressurized air to continue to flow through the spike and out of the tire until the tire is partially or even completely deflated. The foregoing and other features of the device of the present invention will be further apparent from the detailed description which follows.

DETAILED DESCRIPTION

Figure 1:
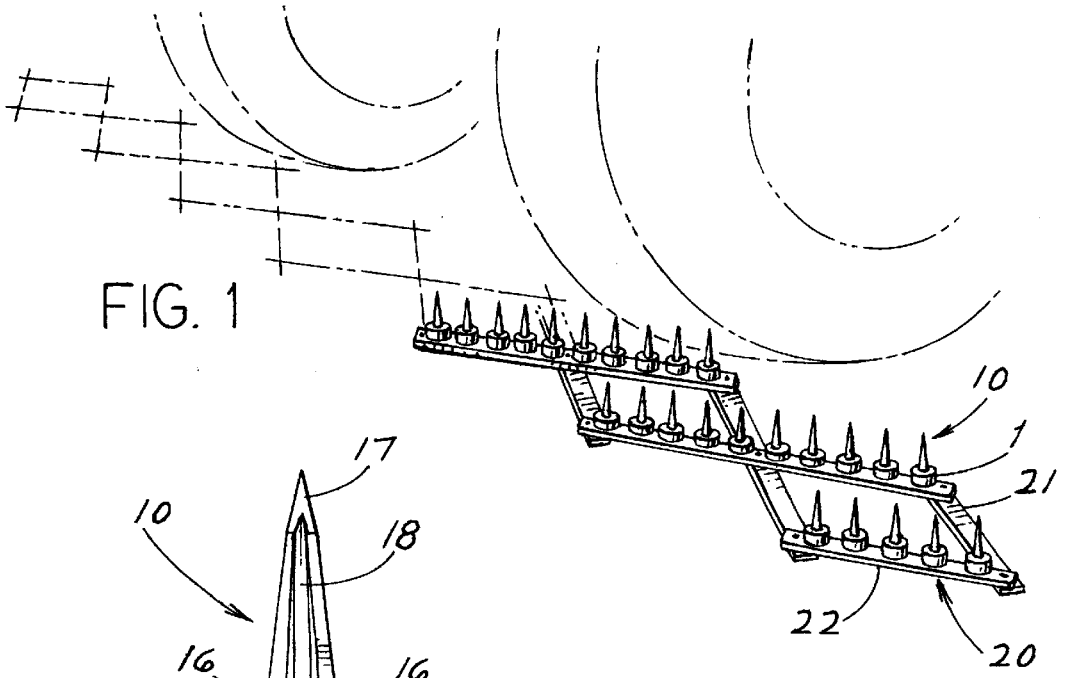
FIG. 1 is a perspective view of a device using an array of the tire puncturing and deflating spikes which are constructed in accordance with the present invention.
Figure 2:
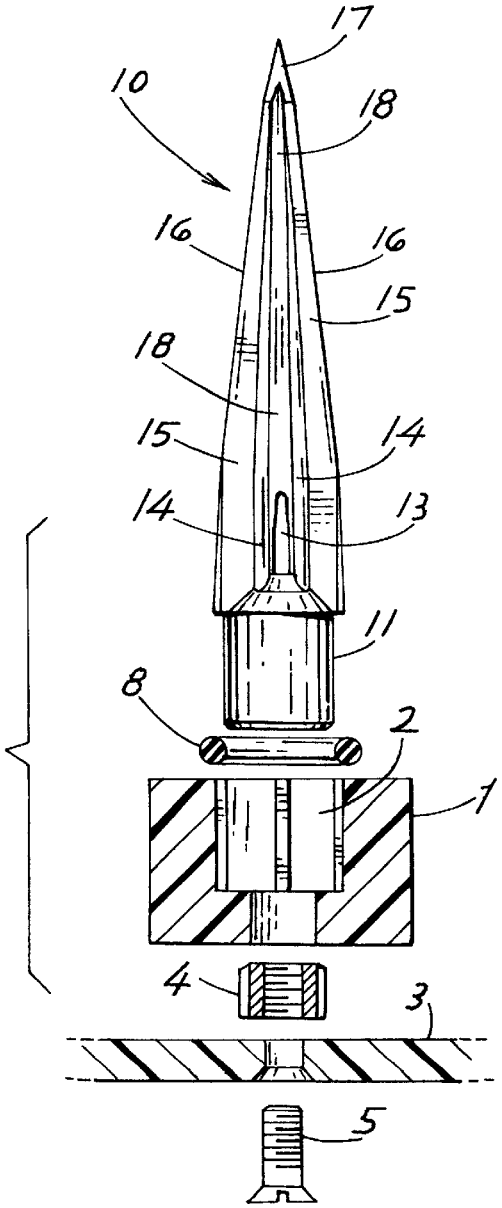
FIG. 2 is an enlarged vertical section through one of the puncturing and deflating spikes shown in FIG. 1 and further showing, in particular, an exploded view of one embodiment of the spike seat assembly.
Figure 3:
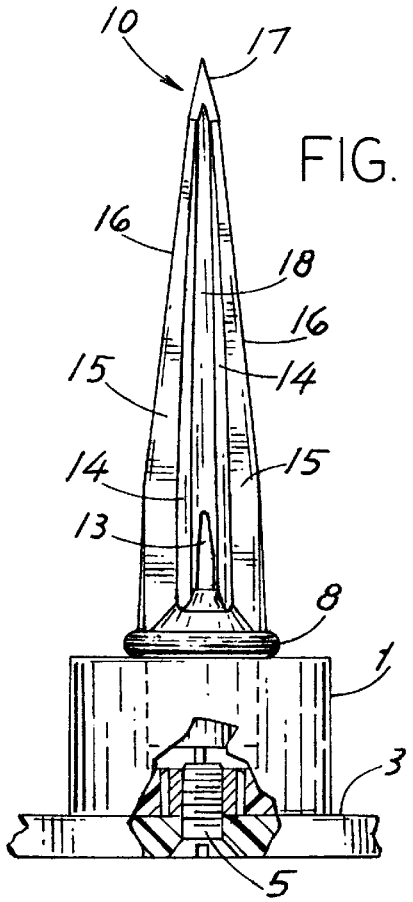
FIG. 3 is an enlarged vertical view of the puncturing and deflating spike shown in FIG. 2.
Figure 5:
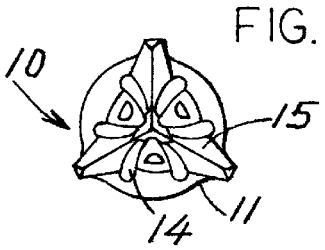
FIG. 5 is an enlarged top plan view of the puncturing and deflating spike shown in FIG. 3.
Figure 4:
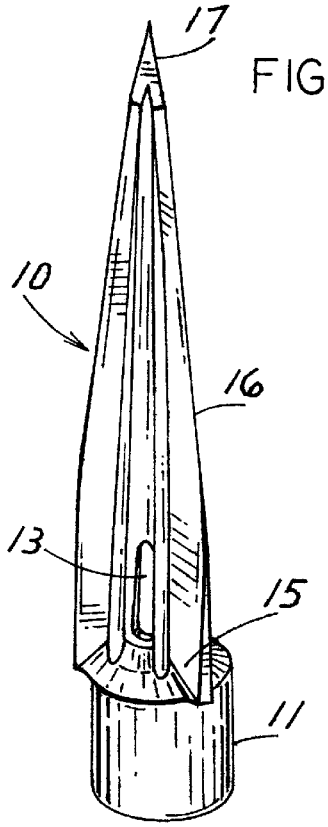
FIG. 4 is a perspective view of the puncturing and deflating spike shown in FIG. 3.
Figure 9:
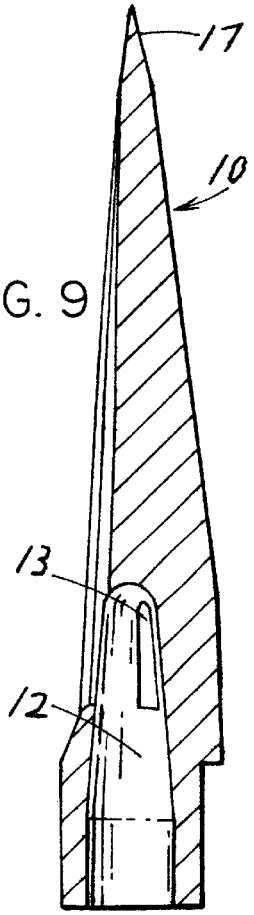
FIG. 9 is a vertical section of the spike shown in FIG. 6 and taken along Line 9—9 in FIG. 8.
Figure 6:
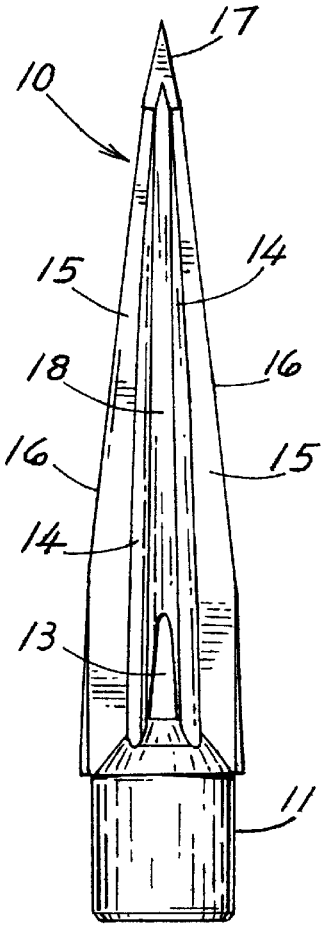
FIG. 6 is an enlarged vertical view of the puncturing and deflating spike shown in FIG. 3.
Figure 7:
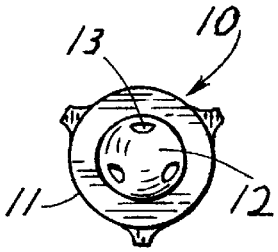
FIG. 7 is an enlarged bottom plan view of the puncturing and deflating spike shown in FIG. 3.
Figure 8:
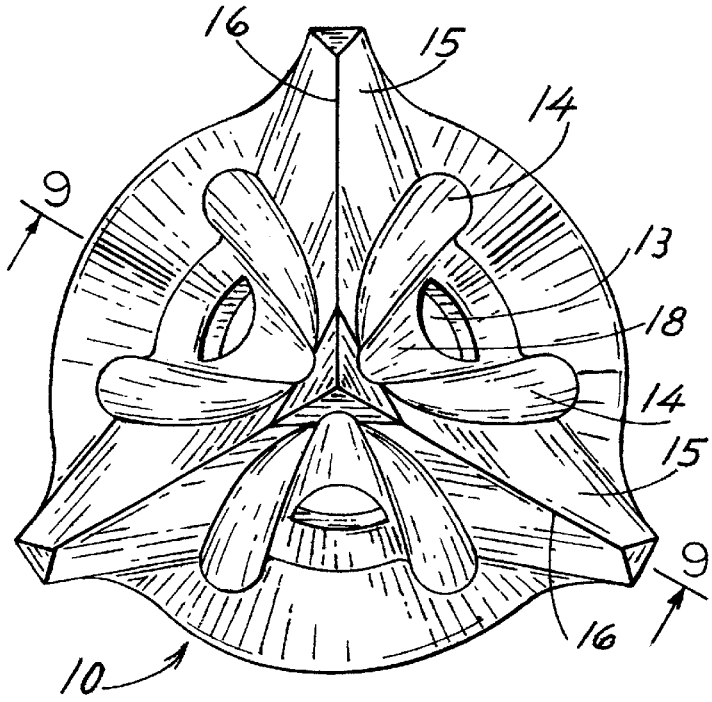
FIG. 8 is a greatly enlarged top plan view of the puncturing and deflating spike shown in FIG. 3.

Referring now to the drawings in detail, FIG. 2 shows a preferred embodiment of a puncturing and deflating spike, generally identified 10, which is constructed in accordance with the present invention. As shown in FIG. 1, an array of such spikes 10 is included in a scissors-like assembly, generally identified 20, which includes rotatably attached base members 21, 22. In this fashion, the assembly 20 can be significantly reduced in size and can be transported between locations when such is desired or required. It also allows the assembly to be used over and over again. While disclosed as a preferred embodiment, it should be understood that any number of such expandible and portable arrays could be constructed without deviating from the scope of the present invention.

As shown in FIG. 2, the assembly base member 3 is fitted with a number of spike holders 1. The spike holder 1 of the present invention is made of a rigid plastic material. The spike holder 1 is attached to the base member 3 by virtue of a screw 5 and nut 4 used in combination. It should also be mentioned that this inventor has configured a base member 3 which is constructed with an integrally formed spike holder 1, thereby eliminating the need for the extra screw 5 and nut 4 as shown. The critical function performed by either spike holder configuration is that the spike 10 be retained within the spike holder void 2 until the spike 10 is ready to be deployed by the assembly 20. To that end, the puncturing and deflating spike 10 of the present invention includes a cylindrical spike base 11 which is functionally adapted to fit within the spike holder void 2. The spike base 11 is fitted with a rubber ring 8 which helps retain the spike 10 in position. This inventor has also experienced success by utilizing a viscous silicon rubber sleeve or band which is functional throughout a wide range of temperatures in retaining the spike base 11 in place and allowing it some movement within the spike holder 1.

As also shown in FIG. 2, the puncturing and deflating spike 10 of the present invention includes an upwardly extending plurality of spike blades 15. Extending from the spike base 11, the spike blades 15 come together and culminate in a spike point 17. It is this spike point 17 which serves as the initial portion of the spike 10 to contact and pierce one or more of the rubber tires of a motor vehicle traveling over the assembly 20. Each of the spike blades 15 of the spike 10 has a razor sharp blade edge 16 which helps slice through the rubber tire and through the steel bands contained within it as the weight of the vehicle bears upon the spike 10. Situated between each of the spike blades 15 is a longitudinally extending spike groove 18. Each spike groove 18 extends along the length of the spike 10, beginning just below the point 17 of the spike 10 and ending just above the spike base 11. To each side of each spike groove 18 is a spike fillet 14. The purpose and function of this pair of spike fillets 14 will become more apparent further in this detailed description.

As previously disclosed, the tire puncturing and deflating spike 10 of the present invention includes a spike base void 12. The spike base void 12, in actuality, extends up and into the spike 10 and terminates at a point where the spike base void 12 meets, or intersects, the spike grooves 18 which run along the exterior of the spike 10. In this fashion, the spike 10 of the present invention creates an air flow continuum which begins just below the point 17 of the spike 10, runs along the number of spike grooves 18 and terminates in a like number of openings 13 to the spike base void 12. It is this feature of the spike 10 of the present invention which aids in the tire deflating function of the spike 10, even when used to pierce today's anti-leak tires. It should also be mentioned that the placement of the spike openings 13 in the spike 10 is such that strength of the uppermost portion of the spike 10 is maximized whereby the possibility of the air flow along the spike 10 being interrupted because of a collapsed spike 10, or a portion of it, is minimized.

In application, a plurality of puncturing and deflating spikes 10 are loaded into the scissors assembly 20, or other similar assembly. In this fashion, deployment of the assembly 20 across the anticipated path of the run-away motor vehicle by law enforcement officers makes the assembly 20 ready for action. When the rubber motor vehicle tire encounters the assembly 20, the foremost portion of the vehicle tire encounters the spike point 17. As the weight and forward progress of the tire forces it to roll over the spike 10, the uppermost portion of the spike 10 is urged into and through the tire tread. The rubber tire is then pierced by the spike point 17 and the tread is split by the edges 16 of the spike blades 15. As the spike 10 penetrates deeper into the rubber tire, the air chamber of the tire is pierced (not shown). In this fashion, air begins to be discharged from the tire along the spike grooves 18 of the spike 10. Although the physical construction of many of today's rubber tires would have a tendency to close off the flow of air and seal the tire at its puncture site, the strategic presence of fillets 14 to each side of the spike grooves 18 serves to push the rubber tire material back from the innermost and deepest portions of the spike grooves 18. In this fashion, air flow from the tire is initiated and maintained through and along the spike grooves 18. The flow of air continues along the spike grooves 18 until it reaches the air flow vents 13 situated just above the spike base 11. It should also be mentioned that, at some point during this process, the forward progress of the vehicle and its tires has resulted in the spike 10 being pulled away from the spike holder 1 with the assembly 20 being left behind and the spike 10 being firmly imbedded in the tire tread. In this fashion, air flow continues through the air flow vents 13, and through the spike base void 12, until the vehicle tire is substantially deflated or completely flat, at which point the forward progress of the vehicle is substantially impaired.

From the foregoing detailed description of the illustrative embodiment of the invention set forth herein, it will be apparent that there has been provided a new, useful and uncomplicated device for quickly and efficiently puncturing and deflating the rubber tires of a motor vehicle; which requires only a minimal number of elements and which effectively enhances air flow from the tire along the outside of the device and then transfers the air flow to the interior of the device; which can be readily used in a variety of tire deflating arrays and which effectively punctures most, if not all, modern rubber tire constructions; which remains imbedded in the rubber tire until removal is desired or required; and which minimizes the fracturing of puncturing device tips and which avoids any rubber tire material plug from being created in the tire puncturing process.

The principles of this invention having been fully explained in connection with the foregoing, I hereby claim as my invention:

1. A tire spike for use in an assembly for penetrating and deflating one or more tires of a moving vehicle, said tire spike comprising;

a longitudinally extending spike body, said spike body having a first end and a second end, the first end of said spike body including a cylindrical spike base and the second end of said spike body including a spike point, a plurality of outwardly and longitudinally extending spike blades, said spike blades extending between said first and second spike body ends and converging at the spike point of the spike body, a plurality of longitudinally extending grooves, each such groove being situated between adjacent spike blades and extending between said first and second spike body ends, means for pushing tire material away from said spike blade grooves, and a spike base void, said spike base void extending upwardly from said spike base and into said spike body, said spike base void intersecting said spike grooves to form a plurality of longitudinally extending slots, one slot along each spike groove, whereby an airflow continuum is formed along the spike grooves, through the slots and through the spike base void when the pressurized air chamber of a vehicle tire is punctured by the tire spike.

2. The tire spike of claim 1, wherein said tire material pushing means comprises a plurality of longitudinally extending spike fillet pairs, said spike fillet pairs being configured such that one spike fillet lies to either side of a spike groove and each pair lies between adjacent spike blades.

3. The tire spike of claim 2 wherein said tire spike is made of a metal material.

4. The tire spike of claim 3 wherein said tire spike has three spike blades, three grooves, three groove slots and three spike fillet pairs.

5. A tire spike for use in an assembly for penetrating and deflating one or more tires of a moving vehicle, said tire spike comprising;

a longitudinally extending spike body, said spike body having a first end and a second end, the first end of said spike body including a cylindrical spike base and the second end of said spike body including a spike point, a plurality of outwardly and longitudinally extending spike blades, said spike blades extending between said first and second spike body ends and converging at the spike point of the spike body, a plurality of longitudinally extending grooves, each such groove being situated between adjacent spike blades and extending between said first and second spike body ends, a plurality of longitudinally extending spike fillet pairs, said spike fillet pairs being configured such that one spike fillet lies to either side of a spike groove and each pair lies between adjacent spike blades, and a spike base void, said spike base void extending upwardly from said spike base and into said spike body, said spike base void intersecting said spike grooves and said spike fillets to form a plurality of longitudinally extending slots, one along each spike groove whereby an airflow continuum is formed along the spike grooves, through the slots and through the spike base void when the pressurized air chamber of a vehicle tire is punctured by the tire spike.

6. The tire spike of claim 5 wherein each spike blade includes a sharp blade edge for slicing through the tire and a puncture resistant band imbedded therein.

7. The tire spike of claim 6 wherein said tire spike is made of a metal material.

8. The tire spike of claim 7 wherein said tire spike has three spike blades, three grooves, three groove slots and three spike fillet pairs.

9. A vehicle tire spike assembly for puncturing and deflating one or more tires of a moving vehicle, said tire spike assembly comprising;

a support base, said support base having an upwardly facing top surface, a plurality of tire spike holders attached to the upwardly facing top surface of said support base, and a plurality of tire spikes, each of said tire spikes comprising a longitudinally extending spike body, said spike body having a first end and a second end, the first end of said spike body including a cylindrical spike base and the second end of said spike body including a spike point; a plurality of outwardly and longitudinally extending spike blades, said spike blades extending between said first and second spike body ends and converging at the spike point of the spike body; a plurality of longitudinally extending grooves, each such groove being situated between adjacent spike blades and extending between said first and second spike body ends; means for pushing tire material away from said spike blade grooves; and a spike base void, said spike base void extending upwardly from said spike base and into said spike body, said spike base void intersecting said spike grooves to form a plurality of longitudinally extending slots, one slot along each spike groove, whereby an airflow continuum is formed along the spike grooves, through the slots and through the spike base void when the pressurized air chamber of a vehicle tire is punctured by the tire spike.

10. The tire spike assembly of claim 9 wherein the tire material pushing means of each of said tire spikes comprises a plurality of longitudinally extending spike fillet pairs, said spike fillet pairs being configured such that one spike fillet lies to either side of a spike groove and each pair lies between adjacent spike blades.

11. The tire spike assembly of claim 10 wherein each of said tire spikes is made of a metal material.

12. The tire spike assembly of claim 11 wherein each of said tire spikes has three spike blades, three grooves, three groove slots and three spike fillet pairs.

13. The tire spike assembly of claim 12 wherein said support base comprises a scissor-like assembly of rotatably interconnected base members whereby the support base can be extended in a horizontal plane and across the path of a moving vehicle.

14. The tire spike assembly of claim 13 wherein each of said tire holders is made of a rigid plastic material.

* * * * *